US005703339A

United States Patent [19]

Rapp et al.

[11] Patent Number: 5,703,339

[45] Date of Patent: Dec. 30, 1997

[54] SAFETY SWITCH

[75] Inventors: Werner Rapp, Geislingen; Peter Schmidt, Stuttgart, both of Germany

[73] Assignee: Euchner & Co., Germany

[21] Appl. No.: 704,741

[22] PCT Filed: Feb. 25, 1995

[86] PCT No.: PCT/EP95/00689

§ 371 Date: Sep. 9, 1996

§ 102(e) Date: Sep. 9, 1996

[87] PCT Pub. No.: WO95/24726

PCT Pub. Date: Sep. 14, 1995

[30] Foreign Application Priority Data

Mar. 10, 1994 [DE] Germany ..... 44 08 024.7

[51] Int. Cl.[6] ..... H01H 27/00

[52] U.S. Cl. ..... 200/17 R; 200/43.07; 200/61.62

[58] Field of Search ..... 200/17 R, 43.01, 200/43.04, 43.05, 43.06, 43.07, 43.08, 43.09, 50 R, 50 A, 50 B, 50 C, 61.62, 61.63, 61.64, 61.65, 61.66, 61.67, 61.68, 334

[56] References Cited

U.S. PATENT DOCUMENTS

| | | | |
|---|---|---|---|
| 3,817,611 | 6/1974 | Brown | 352/155 |
| 3,924,085 | 12/1975 | Stone | 200/61.62 |
| 4,321,445 | 3/1982 | Kristof et al. | 219/10.55 C |
| 4,506,121 | 3/1985 | Peterson et al. | 200/50 B |
| 4,524,251 | 6/1985 | Schulz | 200/42 R |
| 4,904,829 | 2/1990 | Berthaud et al. | 200/50 R |
| 5,147,988 | 9/1992 | Appleton | 200/51.09 |
| 5,464,954 | 11/1995 | Kimura et al. | 200/61.62 |
| 5,473,127 | 12/1995 | Falcon et al. | 200/43.04 |
| 5,516,993 | 5/1996 | Wecke et al. | 200/17 R |
| 5,587,569 | 12/1996 | Mohtasham | 200/17 R |

FOREIGN PATENT DOCUMENTS

| | | |
|---|---|---|
| 0 129 253 | 12/1984 | European Pat. Off. . |
| 37 10079 A1 | 10/1988 | Germany . |
| WO 93/24947 | 12/1993 | United Kingdom . |

*Primary Examiner*—Adolf Berhane

*Attorney, Agent, or Firm*—Wigman, Cohen, Leitner & Myers, P.C.

[57] ABSTRACT

A safety switch has a key (1) which, when inserted into and removed from a key channel (9), forcibly rotates a cam plate (7) and so switches over the switch. The safety switch further has an interlocking device for the cam plate (7) which is disposed adjacent the latter, can be forcibly released by the key (1) when it is introduced into the key channel (9) and has at least one locking member (21) which can be displaced in translation and, in its locked position, engages in an interlocking manner with a housing disposed adjacent the cam plate (7). The locking member (21) can be displaced into the released position by the key (1) by means of an actuating member (15) which is moveable together with the locking member (21) and is integral therewith. The part of the actuating member (15) which projects into the key channel (9) in the locked position is connected to the locking member (21) by means of a material section which is laterally guided past the axis of rotation (6).

10 Claims, 1 Drawing Sheet

1
1'
11
11'
2
3
4
5
6
7
7'
8
8'
9
10
12
13
14
15
16
17
18
19
20
21
III

SAFETY SWITCH

BACKGROUND OF THE INVENTION

In a known switch of this type, the locking member is constructed as a metallic, longitudinally displaceable locking pin which, in the locked position, engages a little in a transverse bore of a plate arranged next to the cam plate and constructed with the latter in one piece. A metallic actuating pin is arranged as actuating member in this transverse bore, which is open with a reduced cross-section towards the key channel. In the locked position, the locking pin keeps the actuating pin in a position in which the latter projects into the key channel. When the key is inserted into the key channel, it must firstly displace the actuating pin so far that the locking pin no longer engages in the bore. Since the key rotates the cam plate after the unlocking, the actuating pin no longer bears against the locking pin in the release position. In order, nevertheless, for both the actuating pin and the locking pin to retain their positions, corresponding bearing surfaces must further be provided for the two pins. The known safety switch is therefore relatively complicated.

OBJECTS AND SUMMARY OF THE INVENTION

It is the object of the invention to provide a more cost-effective safety switch. This object is achieved by a safety switch having the features described and claimed herein.

Owing to the fact that the part of the actuating member projecting into the key channel in the locked position is connected to the locking member via a material part guided laterally past the axis of rotation of the cam plate, the actuating member can be constructed in one piece with the locking member, as a result of which the costs are considerably diminished already purely by the reduced number of the individual parts to be produced and assembled.

The actuating member is preferably constructed as a sliding member which lies in a plane parallel to the cam plate and is provided with a cutout for passage of the axis of rotation. The expenditure for guiding such a sliding member is very low. This applies particularly whenever the cutout is constructed as an elongated hole having a width which is coordinated with the diameter of the axis of rotation, because then the sliding member can be guided by the axis of rotation.

The locking member is preferably formed by a stop for a stop surface of the receptacle, which is formed by a material part provided on the side of the cam plate facing the sliding member. This material part preferably takes the form of a plate into which there penetrates from the circumferential surface a slot-like recess one edge of which forms the stop surface. Such a receptacle can be produced very cost-effectively, since it can also be open in the axial direction.

In the case of a receptacle in the form of a slot-like recess, the stop which forms the locking member preferably has a tooth-like form. A locking member constructed in this way also contributes to the fact that the component forming the locking member and the actuating member can take a form which is simple and cost-effective.

Since the actuating member has at least one material part guided laterally past the axis of rotation, the locking member could lie in the plane defined by the actuating member. In a preferred embodiment, however, the locking member is arranged next to the actuating member on the side thereof facing the cam plate, in radial alignment with the material part forming the receptacle.

A minimum of individual parts is achieved when the material part forming the receptacle is constructed in one piece with the cam plate and the axis of rotation thereof.

Furthermore, on grounds of cost, in a preferred embodiment both the cam plate with the material part forming the receptacle and the axis of rotation, as well as the actuating member and the locking member constructed in one piece with it consist of plastic. Such plastic parts can be produced very cost-effectively.

To the extent that a second locking member with an associated actuating member is provided for safety reasons, the said members are constructed on grounds of cost like the first locking member and the actuating member thereof, respectively. Furthermore, the receptacle assigned to the second locking member is also constructed like the receptacle assigned to the first locking member.

DESCRIPTION OF THE DRAWINGS

The invention is explained in detail below with the aid of an exemplary embodiment represented in the drawing, in which.

DESCRIPTION OF THE PREFERRED EMBODIMENT

Figures 1, 2, 3:
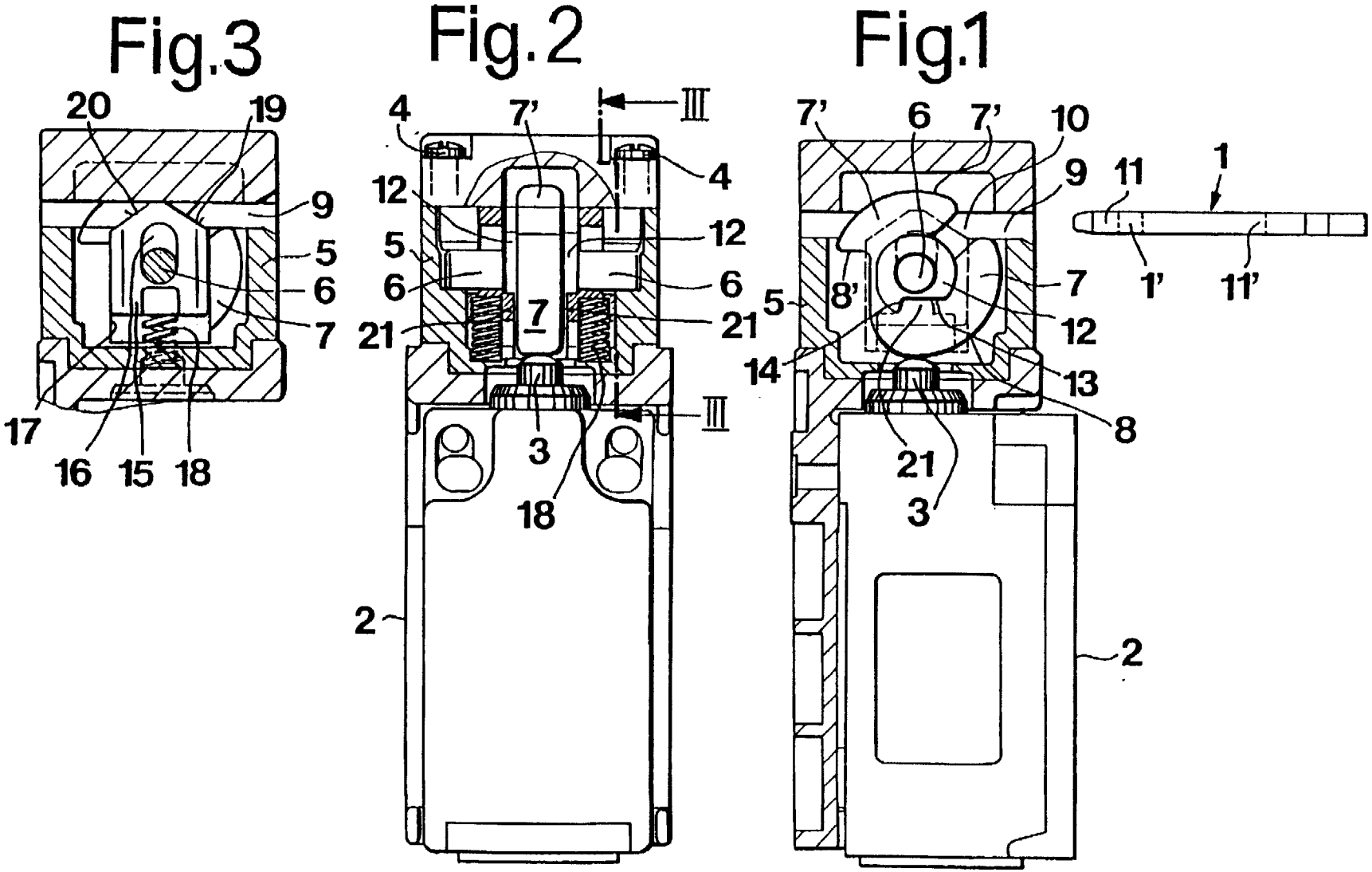
FIG. 1 shows a side view, represented partially cut away, of the exemplary embodiment with associated key.
FIG. 2 shows another, second, side view, represented likewise partially cut away, of the exemplary embodiment.
FIG. 3 shows a section along the line III—III of FIG. 2.

A safety switch, which can be operated only by means of an associated key 1, contains in a main part 2 of its housing, which consists of plastic, a switch (not represented) which is operated by means of a plunger 3 which is arranged in the housing in a fashion capable of longitudinal displacement. A head part 5, which can, instead of being arranged in the position represented in FIGS. 1 and 2, also be arranged rotated by 90° with respect to the main part 2 about the longitudinal axis of the plunger 3, is fastened by means of screws 4 to one end face of the main part 2 of the housing.

Rotatably mounted in the head part 5 with an axis 6 of rotation extending at right angles to the longitudinal axis of the plunger 3 is a cam plate 7 which is aligned with the dome-shaped end, which points towards it, of the plunger 3. This end of the plunger 3 is held by means of a spring (not represented) bearing against the control cam 8 formed by a part of the circumferential surface of the cam plate 7. A segment 7' of the cam plate 7 whose lateral surface does not form the control cam 8 projects into a key channel 9 which penetrates the head part 5 transverse to the longitudinal direction of the axis 6 of rotation. A groove 10 of the cam plate 7, which is provided between one end of the segment 7' and that of the segment forming the control cam 8, serves to receive a transverse web 1' of the key 1, which separates a first longitudinal slot 11 of the key 1 from a second longitudinal slot 11' extending up to the front end of the said key. The two longitudinal slots 11 and 11' have a width measured transverse to the longitudinal direction of the key 1 which is greater than the thickness, measured in the axial direction, of the cam plate 7. The latter can therefore engage in the first longitudinal slot 11 and the second longitudinal slot 11'.

A plate-shaped material part 12 is integrally formed on the cam plate 7, on both sides thereof. These two identically constructed material parts 12 form together with the cam plate 7 and the axis 6 of rotation a single-piece component made from plastic. As FIG. 1 shows for one material part 12, they both have a slot-like recess 13 which is open both radially outwards and in the axial direction and which forms with one of its edges a stop surface 14 extending approximately radially.

One sliding member 15 each is arranged in the head part 5 in a fashion capable of being displaced in the longitudinal direction of the plunger 3 on each side of the cam plate 7 immediately next to the plate-shaped material part 12 respectively present here. Apart from their end zone pointing towards the main part 2 of the housing, the two identically constructed sliding members 15 have the form of a flat rail which lies in a plane parallel to the cam plate 7. As FIG. 3 shows, in particular, the sliding member 15 is penetrated in the middle by an elongated hole 16 which extends in the direction of displacement and whose width is adapted to the diameter of the axis 6 of rotation, as a result of which the sliding member 15 is guided through the axis 6 of rotation. However, the head part 5 is provided in the exemplary embodiment with one additional, slot-like guide 17 each for the two sliding members 15. One preloaded helical spring 18 each, of which one end section is received by a blind bore in the end zone of the sliding member 15, attempts to hold the sliding member 15 in the locked position, represented in FIGS. 1 to 3, in which its end section averted from the main part 2 of the housing projects into the key channel 9. As is to be seen from FIG. 3, above all, this end section forms two ramps 19 and 20 inclined in opposite directions. The key 1 runs against one 19 of the ramps upon insertion into the key channel. The other ramp 20 is required because the two sliding members 15 are of identical construction and are arranged in mirror-image fashion relative to the cam plate 7 in the head part 5.

On the side, facing the cam plate 7, of the end zone of the sliding member 15, a locking member 21 is integrally formed like a tooth which points in the radial direction against the axis 6 of rotation and is aligned with the plate-shaped material part 12, that is to say lies in the same plane as the latter. The sliding member 15 forms the actuating member for the locking member 21. As FIG. 1 shows, in its locked position the locking member 21 engages in the recess 13 of the assigned plate-shaped material part 12 in such a way that one of its edges bears against the stop surface 14, and its head surface bears against the edge of the recess 13 which adjoins the stop surface 14. In its locked position, the locking member 21 therefore prevents the cam plate 7 from being capable of rotation, specifically in a self-closed fashion for the direction of rotation for the purpose of switch operation, that is to say in an anticlockwise sense in the case of a direction of view in accordance with FIG. 1, since in the case of this direction of rotation the plunger 3 runs from the highest point of the control cam 8 to the lowest point, which is adjoined by a shoulder 8' which prevents further rotation.

When the key 1 is inserted into the key channel 9, it initially runs against the ramp 19 or 20 of the two sliding members 15, as a result of which the latter are displaced so far against the main part 2 of the housing that the locking member 21 releases the associated stop surface 14. The transverse web 1', which enters the groove 10, can now rotate the cam plate 7, as a result of which the plunger 3 comes to bear against the lowest section of the control cam 8, the consequence being that the switch is closed. In this rotary position (not represented) of the cam plate 7, the two locking members 21 are held in the release position by the key 1.

When the key 1 is withdrawn from the key channel 9, the cam plate 7 is positively rotated, specifically in the clockwise sense in the case of a direction of view in accordance with FIG. 1, the consequence being that the plunger 3 is positively moved against the switch operated by it, the consequence being positive opening of this switch. When the key 1 has left the ramp 19 or 20, operated during insertion, upon being withdrawn from the key channel 9, it releases the two sliding members 15. The helical springs 18 then again push the two sliding members 15 into the locked position, in which each of the two locking members 21 bears against the assigned stop surface 14.

Both the production costs and the outlay on assembly are very low, because the safety switch comprises a minimum of individual parts which, in addition, are simple to assemble, specifically, apart from the housing and the screws 4 connecting two parts thereof together, the switch with the plunger 3, the component comprising the cam plate 7, the axis 6 of rotation and the plate-shaped material parts 12, the two sliding members 15, each forming one of the locking members 21 and the actuating member thereof, and the two helical springs 18.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed:

1. Safety switch comprising:

a) a switch housing including a switch;

b) a plunger, arranged in the switch housing in a fashion capable of displacement in its longitudinal direction against the force of a spring, for actuating said switch arranged in the switch housing, c) a cam plate, which is mounted in the switch housing with an axis of rotation extending at right angles to the longitudinal axis of the plunger, and against whose lateral surface, which forms the control cam, the plunger bears, d) a key channel in the switch housing, into which the cam plate projects, e) a key which upon being inserted in and upon being withdrawn from the key channel positively rotates the cam plate about its axis of rotation and in so doing switches over the switch, f) a self-closed locked device, arranged next to the cam plate and capable of being positively released by means of the key upon insertion into the key channel, for the cam plate, having at least one locking member which can be displaced in a translatory fashion and which engages in a self-closed fashion in its locked position with a receptacle arranged next to the cam plate and can be displaced by the key into the release position, g) an actuating member constructed in one piece with the locking member and projects into the key channel in the locked position, wherein the part of the actuating member which projects into the key channel in the locked position is connected to the locking member via a material part guided laterally past the axis of rotation.

2. Safety switch according to claim 1, wherein the actuating member is formed by a sliding member which lies in a plane parallel to the cam plate and is provided with a cutout for passage of the axis of rotation.

3. Safety switch according to claim 2, wherein the cutout is constructed as an elongated hole (16) having a width which is coordinated with the diameter of the axis (6) of rotation.

4. Safety switch according to claim 3, wherein the locking member is constructed by a stop for a stop surface of the receptacle, which is formed by a material part provided on the side of the cam plate facing the sliding member.

5. Safety switch according to claim 4, wherein the material part provided next to the cam plate is formed by a plate, and the stop surface is formed by an edge of a slot-like recess which penetrates into the plate from the circumferential surface thereof.

6. Safety switch according to claim 5, wherein the stop of the locking member is of tooth-like construction.

7. Safety switch according to claim 6, wherein the locking member is arranged next to the actuating member on the side thereof facing the cam plate, in radial alignment with the receptacle.

8. Safety switch according to claim 7, wherein the material part forming the receptacle is constructed in one piece with the cam plate and the axis of rotation.

9. Safety switch according to claim 8, wherein both the cam plate as well as the actuating member are plastic.

10. Safety switch according to claim 9, wherein a second locking member with an associated actuating member, which are constructed like the first locking member and the actuating member thereof, respectively, are arranged next to the cam plate on the side thereof averted from the first locking member, and in that the second locking member is assigned a second receptacle which is arranged next to the cam plate on the side averted from the first receptacle and is constructed like the first receptacle.

* * * * *